United States Patent [19]

Prehodka

[11] 4,383,688

[45] May 17, 1983

[54] OBSTACLE FOR TOY VEHICLE TRACK

[75] Inventor: Barry V. Prehodka, Ridgefield, Conn.

[73] Assignee: Aurora Products Canada Limited, Ontario, Canada

[21] Appl. No.: 227,578

[22] Filed: Jan. 23, 1981

[51] Int. Cl.[3] ..... A63F 9/14

[52] U.S. Cl. ..... 273/86 B; 46/1 K

[58] Field of Search ..... 273/86 R, 86 B; 46/1 K, 46/202; 104/60, 304, 305

[56] References Cited

U.S. PATENT DOCUMENTS

| | | | |
|---|---|---|---|
| 2,676,019 | 4/1954 | Steinberg | 273/141 R |
| 3,402,503 | 9/1968 | Glass et al. | 273/86 B X |
| 3,456,596 | 7/1969 | Cooper | 104/60 |
| 3,618,947 | 11/1971 | Cooper et al. | 273/86 R |
| 4,168,067 | 9/1979 | Wiczer | 273/127 R |

FOREIGN PATENT DOCUMENTS

| | | | |
|---|---|---|---|
| 496552 | 11/1938 | United Kingdom | 104/60 |

*Primary Examiner*—Anton O. Oechsle

*Attorney, Agent, or Firm*—Blum, Kaplan, Friedman, Silberman & Beran

[57] ABSTRACT

A pivotable vane positioned between lanes of a multi-laned track is actuated by a toy vehicle to obstruct one of the lanes after the vehicle has passed. In a slotless track any pursuing vehicle in an obstructed lane must be diverted to another lane or collide with the obstacle which is designed to throw a colliding vehicle off the track. In a slotted track, the pursuing vehicle in an obstructed lane must wait for the competitor to clear the obstacle.

16 Claims, 7 Drawing Figures

OBSTACLE FOR TOY VEHICLE TRACK

BACKGROUND OF THE INVENTION

This invention relates generally to a track for powered toy vehicles of the type used in track racing games, and more particularly to an obstacle for a multi-laned track. Racing of toy vehicles on a closed loop track has become increasingly popular. Generally, the vehicles are electrically driven by means of conductors, embedded in the track surface, which engage brushes on the underside of the vehicle whereby power from the track is transmitted to an electric motor in the vehicle. In earlier developments, vehicles raced in parallel lanes and each vehicle was confined to a particular lane by means of a slot in the track which was engaged by a pin extending from the underside of the vehicle. However, the desire to increase the excitement of the play and to add variety to the performance capabilities of the vehicle has led to the use of slotless tracks and steerable vehicles. This gives each vehicle the freedom to operate on any lane, each lane being provided with electrical conductors embedded in the surface. The ability to steer the vehicles permits the use of the vehicles by their operators as an obstacle to competing vehicles, and has led to the design of automatically operated obstacles which are used with the track. Basically, any device which increases the number of options available to the operator for performance and enjoyment adds to the play value of the toys and increases their market appeal. However, the moving obstacle vehicles have proved complicated and expensive and simpler, yet effective obstacles are required. Obstacles usable on slotted tracks are also desired.

SUMMARY OF THE INVENTION

Generally speaking, in accordance with the invention, a track obstacle especially suitable for throwing a vehicle in an obstructed lane off the track is provided. A pivotable vane positioned between adjacent lanes of a multi-laned slotless track is actuated by a toy vehicle to obstruct one of the adjacent lanes after the vehicle has passed. In a slotless track, a following vehicle must be diverted to another lane or collide with the obstacle which is designed to throw the colliding vehicle off the track. In a slotted track, a following vehicle must wait for a vehicle in the unobstructed lane to move the vane. The vane pivots on a pin extending vertically from the track surface. The vane is provided with a fin extending into each adjacent lane such that no vehicle can pass the obstacle on either side without then displacing and pivoting the vane to obstruct a lane.

Accordingly, it is an object of this invention to provide an improved obstacle for a toy vehicle track which when actuated obstructs a lane of the track.

Another object of this invention is to provide an improved obstacle for a toy vehicle track which is actuated to obstruct a lane of the track when a vehicle passes the obstacle.

A further object of this invention is to provide an improved obstacle for a toy vehicle track which is simple in construction, uses no electrical power and is actuated without external control.

Still another object of this invention is to provide an improved obstacle for a toy vehicle track which is readily installed and totally or partially removed without the need for special tools.

Still other objects and advantages of this invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
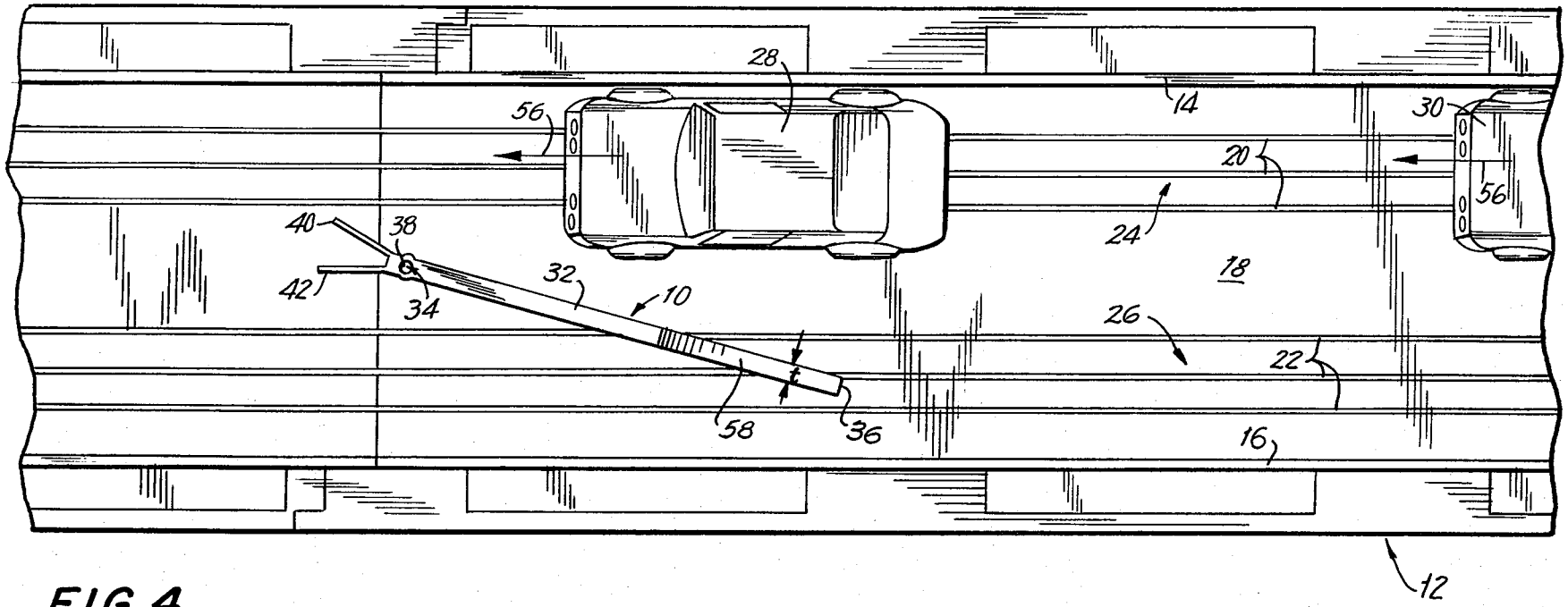
FIG. 1 is a top view of a track obstacle in accordance with this invention, and showing a first car pursued by a second car.

With reference to the figures, an obstacle 10 is positioned on a slotless track 12. The track 12 includes side walls 14,16 a track surface 18 and electrical conductors 20,22 of extended length embedded so as to slightly project from the track surface in the known construction for toy vehicle track racing. The electrical conductors 20,22 are arranged in groups of three conductors so as to form independent and separated lanes 24,26. The lanes 24, 26 are spaced apart so that two toy vehicles are operated independently side-by-side or on the same track without interference. This permits vehicle passing and parallel operation.

In FIG. 1 a first vehicle 28 and a second or pursuing vehicle 30 are shown in the same lane 24 of the track 12. In the known manner, electrical motors are connected to the electrical conductors of the track by means of brushes which are located on the underside of the vehicle. The vehicles 28, 30 may be powered from either track 24, 26 and when the vehicle is steerable, which is the conventional construction, the vehicles 28, 30 can be steered from lane to lane under the direction of an operator who controls the polarity of voltage available in the embedded electrical conductors 20, 22. There are no slots in the surface 18 of the track 12, nor engaging pins on the vehicles 28, 30 which would confine either vehicle to any particular lane or path. The construction of the vehicles with regard to the electrical pickup and steering, or other controls, is not a novel portion of this invention and is not given a detailed description herein for that reason. Similarly, the construction of the track 12 with regard to the electrical conductors 20, 22 is not a novel portion of this invention and also is not described in any further detail herein.

The obstacle 10 is comprised of a vane 32 of extended length mounted on the track surface 18 by means of a pivot pin 34. The vane is a rectangular plate having a length substantially exceeding its height h or thickness t. The vane 32 tapers to a point adjacent to the track surface 18 at the far free end and the vane 32 is attached to the pivot pin 34 substantially at the other end of the vane 32 by insertion of the pin 34 in a hole 38.

A pair of preferably resilient fins 40, 42 are attached to the end of the vane 32 adjacent to the pivot pin 34 and extend divergently and symmetrically away from the vane 32. As stated above, the lanes 24, 26 are spaced apart so that vehicles may operate in parallel at the same linear position along the track 12. The pin 34 is mounted equidistant between the two lanes 24, 26 and the fins 40, 42 diverge and extend sufficiently such that when the obstacle 10 is pivoted as shown in FIG. 1, the fin 40 intersects the path of travel of a vehicle, for example, vehicle 28 in the lane 24, even when the vehicle 28 is pressed against the side wall 14. Thus, when the vehicle 28 passes the obstacle 10, the fin 40 will be struck by the vehicle in the process. Further, the fins 40, 42 extend and diverge such that when the obstacle 10 is aligned parallel to the lanes 24, 26, any vehicle in any lane 24, 26, when passing the obstacle 10, will make contact with one fin 40, 42. Thus, the obstacle 10 is always caused to pivot by a passing vehicle. The vane 32 can be formed of any rigid material, e.g., polypropylene plastic, and the fins 40, 42 are preferably formed integral with the vane 32. The resiliency of the fins is produced by the thinness thereof.

The pivot pin 34 is comprised of a post 44 having an extended flange 46 proximate one end. The post 44 extends through the flange 46 and terminates in a bifurcated ball-like knob 48. A hole 50 is provided through the track surface 18 having a diameter approximately equalling the diameter of the post 44 such that the pivot pin 34 is locked into position on the surface 18 by the knob 48 extending below the surface 18 with the flange 46 resting on the upper side of the surface 18. For assembly of the pivot pin 34 to the track 12, the knob 48, which is fabricated of semi-rigid material, is pressed through the hole 50 with the knob 48 being elastically deformed in the process. The groove 52 in the lower part of the post 44 and in the knob permits such deformation and allows the knob to pass through the hole 50.

In operation, any vehicle approaching the obstacle 10, for example, vehicle 28 of FIG. 1, and not striking the pointed end 36 of the vane 32, strikes either of the fins 40, 42 causing the obstacle 10 to pivot as the vehicle passes. As illustrated in FIG. 1, the vehicle 28 will strike the fin 40 causing the fins 40, 42 to pivot around the pin 34 in the direction indicated by the arrow 54. The elongated vane 32 is pivoted into the position shown in FIG. 2 with the pointed end moving to a position proximate the side wall 14.

Figure 3:
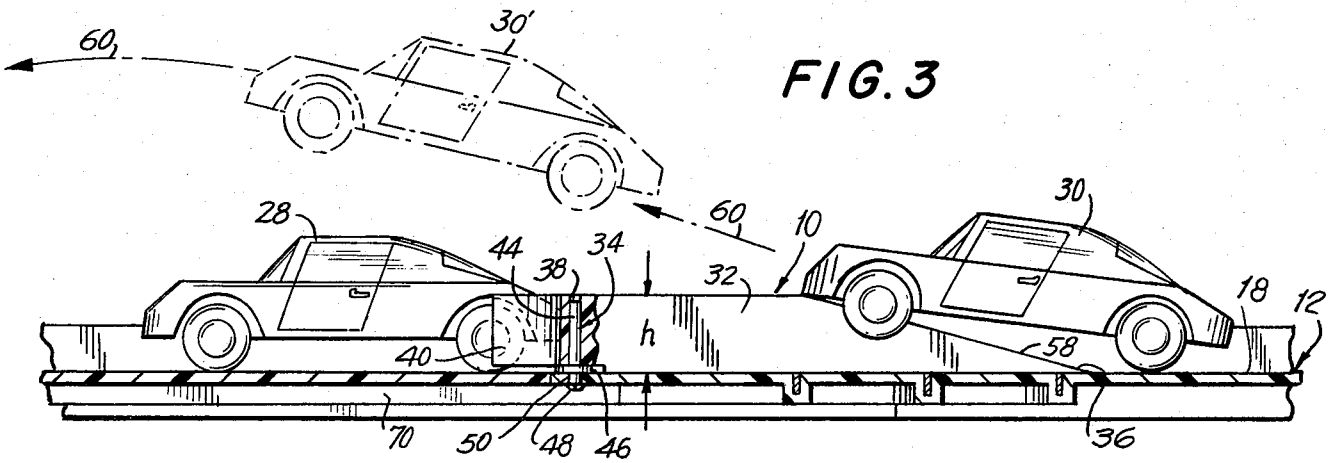
FIG. 3 is a view taken along the line 3—3 of FIG. 2.
Figure 4:
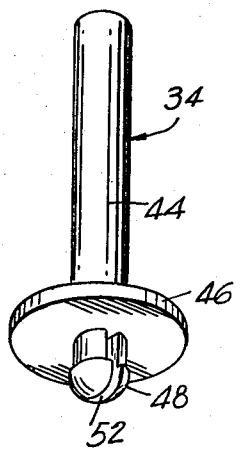
FIG. 4 is a mounting pin for the track obstacle of FIG. 1.
Figure 2:
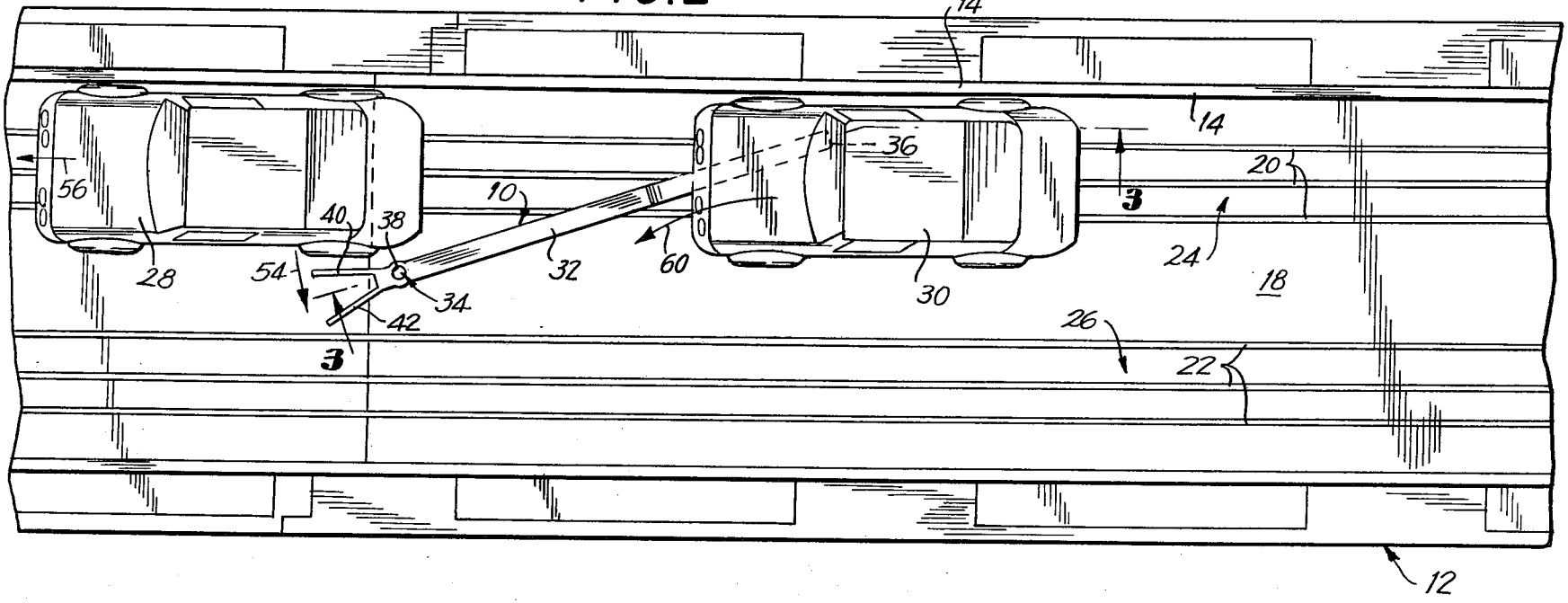
FIG. 2 is a view similar to FIG. 1 showing the condition existing a short time after the condition represented in FIG. 1.

A pursuing vehicle 30, moving along the lane 24 in the same direction as the vehicle 28 as indicated by the arrows 56, in the absence of effective control, strikes the obstacle, and because of its forward velocity rides up the inclined surface 58 and becomes airborne. One possible trajectory is indicated in FIGS. 2 and 3 by the arrows 60. It is possible that an extremely skillful operator might approach the vane 32 at a speed and angle such that the airborne vehicle will land on the track on its wheels and continue in a lane, but this is extremely unlikely. In most cases the airborne vehicle will 37 crash" requiring resetting on the track. It should be understood that a skillful operator of the pursuing vehicle 30 might, under proper circumstances, steer into the other lane 26 and thereby avoid a collision with the obstacle 10. In such a case, the vehicle 30 would strike the fin 42 and cause the obstacle 10 to pivot so as to obstruct the lane 26 after the vehicle 30 has passed.

The precise rest position of vane 32 after the passage of a vehicle thereby is dependent on the speed of the vehicle, the starting position of the vane, and the materials of the fin and track. The vane may come to rest in the adjacent lane as shown in FIG. 2 or rebound off the side wall of the track and come to rest in the same lane. This uncertainty enhances the play value since a closely following vehicle, if cautiously operated, will have to pause to see where the vane comes to rest in order to safely traverse the obstacle.

Although the embodiment illustrated and described herein shows a linearly rising ramp 58 on the obstacle 10, it should be readily understood that in alternative embodiments in accordance with this invention, the vane 32 may have non-linear ramps, and where the distance between lanes permits, the vane 32 can have other than parallel sides as would be illustrated in a top view such as FIG. 1.

Figure 7:
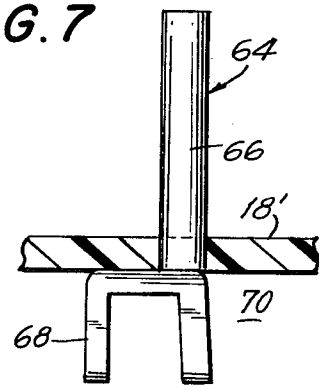
FIG. 7 is a side elevational view of the mounting pin of FIG. 5.
Figure 6:
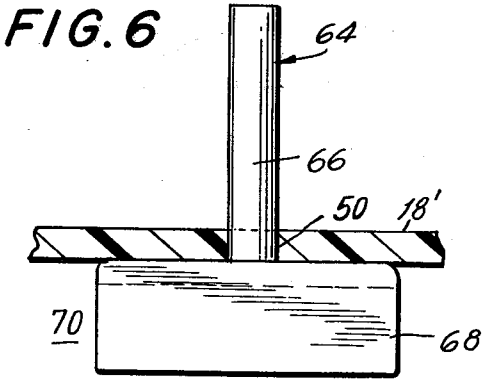
FIG. 6 is a front elevational view of the mounting pin of FIG. 5.
Figure 5:
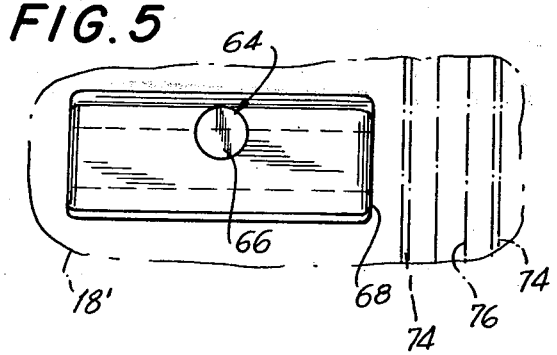
FIG. 5 is a top plan view of an alternative embodiment of a mounting pin for the track obstacle of FIG. 1, mounted on a slotted track shown with phantom lines.

Further, in an alternative embodiment in accordance with this invention, the pivot pin 34, which in the embodiment described above is inserted into a hole 50 in the track surface 18 from above, may be replaced with a pivot pin attached from below and readily removable. With reference to FIGS. 5–7, a pivot pin 64 is comprised of a post attached perpendicularly to the web of a U-shaped channel 68. The post 64 is passed from below through the hole 50 in the track surface 18′ such that the channel 68 abutts the underside of the track surface 18′. As seen in FIG. 3, the track 12 includes a hollow space 70 beneath the running surface 18 where the channel 68 is concealed from view and only the post 66 extends above the surface 18. The obstacle 10 is attached to the post 66 by inserting the post into the hole 38 in the vane 32. The pivot pin 64 is readily removed from the track 12 from below whenever the operators so desire. In the embodiment of FIGS. 5–7, the track 18′ is a slotted track with each lane including a pair of spaced rails 74 and a center groove or slot 76.

The obstacle 10 described above presents the greatest challenge in a slotless track game with steerable vehicles as described above. However, the obstacle 10 can be used with a slotted track. In such a game, the operator of a vehicle on an obstructed lane, not being able to steer his vehicle, would have an option to stop and wait until a vehicle passing in the adjacent lane causes the obstacle to pivot away. Cars in adjacent lanes can pass the obstacle in unison without accident where the fins are flexible, so that a skillful operator can pass the vane at the same instant the other vehicle is passing the vane and the vane is parallel to the side wall of the track. It is noted that in slotted tracks, the center rail in each lane would be replaced with a slot. In a slotted embodiment an airborne vehicle would always "crash".

It will thus be seen that the objects set forth above, among those made apparent from the preceeding description, are efficiently attained and, since certain changes may be made in the above construction without departing from the spirit and scope of the invention, it is intended that all matter contained in the above description or shown in the accompanying drawings shall interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An obstacle for a toy vehicle track, said track having a surface including a plurality of lanes, comprising:

a vane of extended length pivotably mounted on said track for oscillatory motion about an axis, at a portion of said track where said pair of lanes are substantially parallel, said vane when in a first pivoted position relative to said pair of lanes, having one end on one side of said axis extending over a portion of a first one of said pair of lanes, the other end of said vane on the other side of said axis concurrently extending over at least a portion of the second one of said pair of lanes, said vane when in a second pivot position relative to said pair of lanes, having said one end on one side of said axis extending over a portion of said second one of said pair of lanes, the other end of said vane on the other side of said axis concurrently extending over at least a portion of said first one of said pair of lanes, said one end of said vane being subject to collision by a toy vehicle in the lane into which said one end extends, the motion of said vehicle being diverted by said collision, said other end of said vane being subject to collision by a vehicle in the lane into which said other end extends, a collision with said other end causing said vane to pivot about said axis, passage thereby of said vehicle occurring without interference in the motion of said vehicle.

2. An obstacle for a toy vehicle track as claimed in claim 1, wherein said vane is adapted when pivoted to move substantially adjacent to said track surface.

3. An obstacle for a toy vehicle track as claimed in claim 2, wherein said one end extends from said pivoting axis in a direction oppostie to the intended motion of toy vehicles on said track, said one end being contoured to divert the motion of a colliding vehicle.

4. An obstacle for a toy vehicle track as claimed in claim 3, and further comprising a pin, said vane pivoting on said pin, said pin being connected to and extending transversely from said track surface.

5. An obstacle for a toy vehicle track as claimed in claim 4, wherein said track is formed with a central opening, said pin being provided with a split lock region for engagement and retention in said opening.

6. An obstacle for a toy vehicle track, said track having a surface including a plurality of lanes, comprising:

a vane of extended length pivotably mounted on said track between a pair of said lanes for oscillatory motion about an axis, said vane in a first pivoted position relative to said pair of lanes, having one end on one side of said axis adapted to extend over a portion of a first one of said pair of lanes, the other end of said vane on the other side of said axis concurrently extending over a at least a portion of the second one of said pair of lanes, said vane being adapted when pivoted to move substantially adjacent to said track surface, said one end extending from said pivoting axis in a direction opposite to the intended motion of toy vehicles on said track, said one end being contoured to divert the motion of a colliding vehicle, said track further including side walls, and the length of said vane from said axis to said one end exceeds the distances from said axis to said side walls.

7. An obstacle for a toy vehicle track, said track having a surface including a plurality of lanes, comprising:

a vane of extended length pivotably mounted on said track between a pair of said lanes for oscillatory motion about an axis, said vane in a first pivoted position relative to said pair of lanes, having one end on one side of said axis adapted to extend over a portion of a first one of said pair of lanes, the other end of said vane on the other side of said axis concurrently extending over at least a portion of the second one of said pair of lanes, said vane being adapted when pivoted to move substantially adjacent to said track surface, said one end extending from said pivoting axis in a direction opposite to the intended motion of toy vehicles on said track, said one end being contoured to divert the motion of a colliding vehicle, said one end tapers down to a point adjacent to said track surface, said tapered surface forming a rising path causing a colliding vehicle to be airborne after collision at sufficient speed.

8. An obstacle for a toy vehicle track as claimed in claim 3 or 7, wherein said track is a slotless track.

9. An obstacle for a toy vehicle track as claimed in claim 3 or 7, wherein said track is a slotted track.

10. An obstacle for a toy vehicle track said track having a surface including a plurality of lanes, comprising:

a vane of extended length pivotably mounted on said track between a pair of said lanes for oscillatory motion about an axis, said vane in a first pivoted position relative to said pair of lanes having one end on one side of said axis adapted to extend over a portion of a first one of said pair of lanes in a direction opposite to the intended motion of toy vehicles on said track, said one end of said vane being adapted to interfere in the passage of a toy vehicle in the first lane into which it extends, the other end of said vane on the other side of said axis extending over at least a portion of the second one of said pair of lanes, said other end of said vane being adapted to permit pivoting of said vane by a vehicle in the second lane into which said vane extends to permit the passage thereby of said vehicle, said other end including a pair of laterally extending fins, said fins extending over at least a portion both said lanes when said one end is aligned centrally between said adjacent lanes, said fins extending in the direction of intended motion of said vehicle.

11. An obstacle for a toy vehicle track as claimed in claim 10, wherein said vane is rigid.

12. An obstacle for a toy vehicle track as claimed in claim 10, wherein said fins are resilient.

13. An obstacle for a toy vehicle track as claimed in claim 10, wherein said fins are symmetrical about the projection defined by said one end.

14. An obstacle for a toy vehicle track, said track having a surface including a plurality of lanes, comprising:

a vane of extended length pivotably mounted on said track between a pair of said lanes for oscillatory motion about an axis, said vane in a first pivoted position relative to said pair of lanes having one end on one side of said axis adapted to extend over a portion of a first one of said pair of lanes in a direction opposite to the intended motion of toy vehicles on said track, said one end of said vane being adapted to interfere in the passage of a toy vehicle in the first lane into which it extends, the other end of said vane on the other side of said axis extending over at least a portion of the second one of said pair of lanes, said other end of said vane being adapted to permit pivoting of said vane by a vehicle in the second lane into which said vane extends to permit the passage thereby of said vehicle, said one end is narrow and tapers to a point adjacent to said track surface and is provided with a narrow, ramp-like top surface forming a rising surface, said one end being contoured to divert the motion of a colliding vehicle and cause said colliding vehicle to be airborne after collision at sufficient speed.

15. An obstacle for a toy vehicle track, said track having a surface including a plurality of lanes and side walls on the outer respective side of said first and second lane, comprising:

a vane of extended length pivotably mounted on said track between a pair of said lanes for oscillatory motion about an axis, said vane in a first pivoted position relative to said pair of lanes having one end on one side of said axis adapted to extend over a portion of a first one of said pair of lanes in a direction opposite to the intended motion of toy vehicles on said track, said one end of said vane being adapted to interfere in the passage of a toy vehicle in the first lane into which it extends, the other end of said vane on the other side of said axis extending over at least a portion of the second one of said pair of lanes, said other end of said vane being adapted to permit pivoting of said vane by a vehicle in the second lane into which said vane extends to permit the passage thereby of said vehicle, the materials and dimensions of said vane being selected so that the rest position of said one end is not normally predictable after said other end is struck by a vehicle, a rest position in the second lane on a rebound off a side wall back to said first lane being possible.

16. An obstacle for a toy vehicle track as claimed in claim 10, and further comprising a central opening between said lanes and pin, said vane pivoting on said pin, said pin being connected to and extending transversely from said track surface, said pin provided with a laterally extending support, said pin extending through said opening from below and being retained in place by said support.

* * * * *